US007846319B2

(12) United States Patent
Koyama et al.

(10) Patent No.: US 7,846,319 B2
(45) Date of Patent: Dec. 7, 2010

(54) ORGANIC COMPOUND HYDROGENATION APPARATUS AND METHOD FOR HYDROGENATING ORGANIC COMPOUND

(75) Inventors: Saburo Koyama, Ichihara (JP); Fumiaki Takagi, Ichihara (JP); Toshio Fuchigami, Yokohama (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 1187 days.

(21) Appl. No.: 10/547,675

(22) PCT Filed: Mar. 5, 2004

(86) PCT No.: PCT/JP2004/002826

§ 371 (c)(1),
(2), (4) Date: Jul. 7, 2006

(87) PCT Pub. No.: WO2004/079050

PCT Pub. Date: Sep. 16, 2004

(65) Prior Publication Data

US 2007/0000788 A1 Jan. 4, 2007

(30) Foreign Application Priority Data

Mar. 5, 2003 (JP) ..... 2003-059058

(51) Int. Cl.
*C25B 9/06* (2006.01)
*C25B 3/00* (2006.01)

(52) U.S. Cl. ..... 205/462; 205/688; 204/272

(58) Field of Classification Search ..... None
See application file for complete search history.

(56) References Cited

U.S. PATENT DOCUMENTS

| | | | | |
|---|---|---|---|---|
| 3,925,173 | A * | 12/1975 | Junghans | 205/429 |
| 4,547,273 | A * | 10/1985 | Ayers | 205/440 |
| 5,358,553 | A | 10/1994 | Najjar et al. | |
| 6,238,530 | B1 | 5/2001 | Yoshida et al. | |

FOREIGN PATENT DOCUMENTS

| | | |
|---|---|---|
| DE | 100 06 449 A1 | 8/2000 |
| JP | 62-070203 | 3/1987 |
| JP | 7-331476 | 12/1995 |
| JP | 09-184086 | 7/1997 |
| JP | 10-195686 | 7/1998 |
| JP | 2001-316315 | 11/2001 |

* cited by examiner

*Primary Examiner*—Harry D Wilkins, III
(74) *Attorney, Agent, or Firm*—Oblon, Spivak, McClelland, Maier & Neustadt, L.L.P.

(57) ABSTRACT

An organic compound hydrogenation apparatus 1 of the present invention includes a reaction cell 13 to which an electrolytic solution is supplied, and an anode 11 and a cathode 12 arranged in the reaction cell 13, in which the cathode 12 is made of a material including a hydrogen storage material, the cathode being arranged as a tubular member so that an organic compound as an object to be treated circulates thereinside. The present invention having the arrangement described above can provide a method for hydrogenating organic compounds and an organic compound hydrogenation apparatus that can enhance efficiency of hydrogenation of the organic compound.

8 Claims, 3 Drawing Sheets

FIG. 2

| CURRENT VALUE (mA) | 50 | 80 | 100 | 120 | 150 | 240 | 300 | 320 | 400 | 500 |
|---|---|---|---|---|---|---|---|---|---|---|
| CELL VOLTAGE (V) | 2.36 | 2.49 | 2.56 | 2.62 | 2.73 | 2.88 | 3.06 | 3.17 | 3.39 | 3.66 |

FIG. 3

| EXAMPLE | ENTRY | CURRENT VALUE (mA) | ELECTRICAL FLOW (F/mol) | REACTION TIME (HOUR) | YIELD (%) | CURRENT EFFICIENCY (%) |
|---|---|---|---|---|---|---|
| 1 | 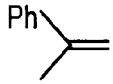 | 260 | 2 | 0.2 | 95 | 95 |
| 2 | 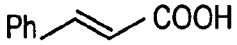 | 260 | 2 | 0.2 | 80 | 80 |
| 3 | 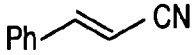 | 260 | 2 | 0.2 | 82 | 82 |
| 4 | 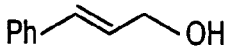 | 260 | 2 | 0.2 | 94 | 94 |
| 5 | 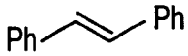 | 260 | 2 | 0.2 | 86 | 86 |

FIG. 4

| | CONCENTRATION (mol/l) | CURRENT VALUE (mA) | ELECTRICAL FLOW (F/mol) | REACTION TIME (HOUR) | YIELD (%) | CURRENT EFFICIENCY (%) |
|---|---|---|---|---|---|---|
| EXAMPLE 6 | 0.1 | 260 | 2 | 0.2 | 92 | 92 |
| COMPARISON | 0.1 | 260 | 2 | 0.2 | 10 | 10 |

FIG. 5

| | ENTRY | ELECTRODE | SOLVENT | CURRENT VALUE (mA) | ELECTRICAL FLOW (F/mol) | REACTION TIME (HOUR) | YIELD (%) | CURRENT EFFICIENCY (%) |
|---|---|---|---|---|---|---|---|---|
| EXAMPLE 7 | 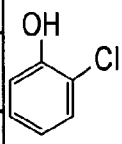 | TUBULAR (1-a) | DISTILLED WATER $H_2O$ | 260 | 2 | 0.2 | 62 | 62 |
| EXAMPLE 8 | | TUBULAR (1-b) | | 260 | 2 | 0.2 | 71 | 71 |
| COMPARISON 2 | | PLATY (1-c) | | 260 | 2 | 0.2 | 8 | 8 |

ORGANIC COMPOUND HYDROGENATION APPARATUS AND METHOD FOR HYDROGENATING ORGANIC COMPOUND

TECHNICAL FIELD

The present invention relates to an organic compound hydrogenation apparatus for conducting hydrogenation of an organic compound, and a method for hydrogenating the organic compound.

BACKGROUND ART

Conventionally, hydrogenation (hydrogenating) reaction of an organic compound and the like has been utilized in various chemical fields and, for example, such hydrogenation reactions are actually utilized as cracking reaction of petroleum in which heavy oil is hydrogenated to obtain gasoline or kerosene and tar fraction is hydrogenised so that it is liquefied to be matched for more purposive use conditions. Further, hydrogenation is utilized in a reaction in which an unsaturated hydrocarbon is converted into a corresponding saturated hydrocarbon, and a reaction in which a halogenated compound is dehalogenated.

In addition, as a method for performing hydrogenation reaction safely and efficiently, there has been known a method in which an organic compound is brought in contact with a metal capable of holding hydrogen such as palladium and hydrogen storage metal alloy.

Further, the aforementioned palladium and many types of hydrogen storage metal alloy have catalysis, and since hydrogen in palladium or other hydrogen storage metals has strong reactivity as active hydrogen, it is said that the palladium and the like function as a hydrogen-supply source and hydrogenation catalyst to exert high function as a method for hydrogenating organic compounds.

However, in the hydrogenation reaction which uses palladium or hydrogen storage metal alloy, since amount of hydrogen that can be absorbed thereinto is limited, there is such a defect that the stored hydrogen is consumed along with progress of the reaction and further reaction does not proceed, thereby allowing only so-called a batch system reaction to proceed. Thus, although there is no problem in a laboratory scale operation, continuous operation is impossible in industrial scales, thereby resulting in much inefficiency.

In order to solve the above-described problem, there are proposed a method in which by using a reaction cell having an anode and a cathode formed in a division plate-like shape and made of a hydrogen storage material, electrolysis is conducted, while allowing an organic compound to contact with the cathode surface on a side not facing the anode, and then active hydrogen generated at the cathode is absorbed and penetrates the cathode to the side not facing the anode to hydrogenate the organic compound; and a technique regarding a reaction cell (Japanese Patent Laid-open Application Publication No. 9-184086).

However, with the aforementioned technique, since a large effective contact area can be obtained between the division plate-like cathode and organic compounds, efficiency of hydrogenation of an organic compound is still insufficient.

DISCLOSURE OF THE INVENTION

An object of the present invention is to provide a method for hydrogenating an organic compound and an organic compound hydrogenation apparatus which are capable of enhancing efficiency of hydrogenation of the organic compound.

In order to achieve the above-described object, an organic compound hydrogenation apparatus according to an aspect of the present invention for hydrogenating an organic compound includes: a reaction cell to which an electrolytic solution is supplied; and an anode and a cathode arranged in the reaction cell, in which the cathode is made of a material including a hydrogen storage material, the cathode being arranged as a tubular member so that the organic compound as an object to be treated circulates thereinside.

Here, as for the anode, platinum, carbon, nickel, stainless-steel and the like can be exemplified. The cathode may be any tubular members, which have a polygonal cross section such as triangle, tetragon or pentagon, or may have a circular or ellipsoidal cross section. A plurality of tubular members may also be used.

As for the hydrogen storage material, palladium, palladium alloy such as palladium-sliver alloy, rare-earth metal alloy such as lanthanum-nickel alloy, misch metal-nickel alloy, titanium, zirconium alloy and the like can be exemplified.

In addition, in order to allow the hydrogenation reaction in the tubular cathode to proceed smoothly, it is preferable that a contact area between the organic compound and the inner surface of the cathode is sufficiently large, and thus desirably the surface of the contact portion is sufficiently roughened.

In order to roughen the inner surface of the tube of the cathode, blast treatment or etching treatment is desirable. Although a degree of treatment is not particularly limited, the blast treatment is preferably carried out by using an alumina grid having around 15 to 20 meshes, whereby substantial surface area becomes 2 to 3 times.

There is no particular limitation for a reaction cell as long as it has a size and shape that can incorporate the anode and cathode.

The electrolytic solution with which the reaction cell is filled is not particularly limited as long as the solution generates hydrogen from the cathode at the time of the electrolysis. For instance, potassium hydroxide, sodium hydroxide and the like can be exemplified a basic electrolytic solution. Also, aqueous sulfuric acid solution, aqueous hydrochloric acid solution and the like can be exemplified as an acidic electrolytic solution.

Reactions generated in the electrolytic solution upon the electrolysis will be described below. When the electrolytic solution is a basic one such as an aqueous potassium hydroxide solution or aqueous sodium hydroxide solution, or is a neutral one, the reaction formula is as shown below in Formula (I).

$$H_2O+e^- \rightarrow Had+OH^- \quad (I)$$

When the electrolytic solution is an acidic one such as an aqueous sulfuric acid solution, an aqueous hydrochloric acid solution, or the like, the reaction formula is as shown below in Formula (II).

$$H^++e^- \rightarrow Had \quad (II)$$

In these Formulae (I) and (II), Had is adsorbed hydrogen and, the reaction according to the above Formula (I) or (II) occurs on the outside surface of the cathode contacting with the electrolytic solution. The Had in Formulae (I) and (II) is held on the outside surface of the cathode in an adsorbed state. The adsorbed hydrogen is converted into a state absorbed in the cathode, as represented by following Formula (III) below.

$$Had \rightarrow Hab \quad (III)$$

In Formula (III), Hab is an absorbed hydrogen. The Hab in Formula (III) reacts with the organic compound supplied inside the cathode to hydrogenate the organic compound.

Hydrogen which has been absorbed in the cathode is consumed only when the cathode contacts with the organic compounds so that hydrogenation of the organic compound occurs. A consumed amount of hydrogen is produced along with the progress of the reaction, and is absorbed in the cathode, thereby leading to a state in which hydrogen is constantly absorbed in the cathode in an amount close to the maximum absorption amount.

The hydrogenation reaction of the organic compound according to the present invention includes reduction reaction of aliphatic or aromatic unsaturated hydrocarbons having a double bond or a triple bond such as ethylene, propylene, 1-octene or 2-octene, acetylene, styrene and quinone into corresponding saturated hydrocarbons, the reaction generating ethane, propane, n-octene (Translator's comment: correctly, n-octane), ethane, ethylbenzene and hydroquinone, respectively.

Further, the hydrogenation reaction of the organic compound according to the present invention also includes dehalogenation reaction of halogenated aromatic compounds such as 2-chlorophenol, 4-chlorotoluene and dioxins, the reaction generating phenol, toluene and dehalgenated compounds of dioxins, respectively.

Examples of the halogenated compound include halogenated aromatic compounds and halogenated aliphatic compounds, and examples of halogen include fluorine, chlorine, bromine and iodine.

Furthermore, a bond of long chain hydrocarbon such as paraffin also can be broken by hydrogenation to generate two or more types of short chain hydrocarbon (cracking). In addition, the present invention can be applied to generate benzyl alcohol by hydrogenation of benzaldehyde and to generate nitrosobenzene or aniline by hydrogenation of nitrobenzene.

The organic compound to be treated is not necessarily in liquid form, but may be in gaseous or solid form. In the case of gaseous form, gas is passed through the cathode as pressurized gas as it stands or by being pressurized. In order to allow the reaction to proceed better, gas may be blown into the cathode. In the case of solid, it may be suspended in a solvent to be brought in contact with the cathode, or may be made into powder and blown as it stands into the cathode.

According to the present invention described above, since the cathode is made of a material including a hydrogen storage material, and is arranged as a tubular member so that the organic compound as an object to be treated circulates inside, conducting electrolysis in a reaction cell filled with an electrolytic solution results in generation of hydrogen on the outer surface of the cathode, and the generated hydrogen is absorbed in the tube wall of the cathode. Then, since the organic compound circulating inside the tube is in a state surrounded by the tube wall of the cathode, it can easily contact with the tube wall in which hydrogen is absorbed, so that a contact area effective for hydrogenation of organic compounds becomes larger as compared to that of a conventional cathode having a division plate-like shape or the like, thereby enhancing the efficiency of hydrogenation of the organic compound.

The cathode may also be formed on a support by coating or the like.

In the organic compound hydrogenation apparatus according to the present invention, it is preferable that the hydrogen storage material is palladium.

With the arrangement, since palladium has very high hydrogen permeability and, has a catalytic activity for hydrogenation, it is suitable for the hydrogen storage material for use in the present invention.

In the organic compound hydrogenation apparatus according to the present invention, it is preferable that the cathode is formed by providing surface treatment on an inner surface of the tubular member with the hydrogen storage material.

Here, example of the surface treatment of the hydrogen storage material on the inner surface of the cathode includes a surface treatment method in which palladium black is formed on the inner surface of the cathode by electrolytic reduction treatment of palladium chloride.

With the arrangement, since the hydrogen storage material itself acts as a catalyst upon hydrogenation reaction of the organic compound, reaction rate of the hydrogenation reaction can be enhanced further.

In the organic compound hydrogenation apparatus according to the present invention, it is preferable that the cathode is formed by filling the tubular member with the hydrogen storage material.

Here, as for the form of the hydrogen storage material, in addition to hydrogen storage material having a shape of powder or fiber, a form in which the hydrogen storage material is supported or coated on various carriers having the shape can be used.

With the arrangement, since the hydrogen storage material has a large surface area, which increases an area where the organic compound contacts effectively with hydrogen, reaction rate of the hydrogenation reaction can further be enhanced.

As for the carrier, those used for usual catalysts can be exemplified, including silica, alumina, silica-alumina, activated carbon, carbon fiber and the like.

A method for hydrogenating an organic compound according to another aspect of the present invention to hydrogenate the organic compound includes the steps of: by using a reaction cell having an anode and a tubular cathode made of a hydrogen storage material, applying voltage between the anode and the cathode to electrolyze an electrolytic solution existing between the anode and the cathode; and circulating the organic compound as the object to be treated inside the tubular cathode to hydrogenate the organic compound.

According to the present invention described above, by electrolyzing the electrolytic solution existing between the anode and cathode, while circulating the organic compound as an object to be treated inside the tube of the cathode, hydrogen is generated on the outer surface of the cathode and the generated hydrogen is absorbed in the tube wall of the cathode. Further, since the circulating organic compound is in a state surrounded by the tube wall of the cathode, it can easily contact with the tube wall in which hydrogen has been absorbed, and the contact area effective for hydrogenation of the organic compound becomes larger as compared to the conventional division plate-like cathode and the like, thereby enhancing the efficiency of hydrogenation of the organic compound.

In the method for hydrogenating the organic compound according to the present invention, feed rate of the organic compound is preferably controlled as needed in accordance with status of the reduction.

BRIEF DESCRIPTION OF DRAWINGS

FIG. 2 is a table showing a relation between electrolysis current value and cell voltage when surface area of an electrolysis cell is 8 $cm^2$ and an electrolytic solution is a 0.3 M aqueous sulfuric acid solution;

FIG. 3 is a table showing measurement conditions and measurement results in Examples 1 to 5;

FIG. 4 is a table showing measurement conditions and measurement results in Examples 6;

FIG. 5 is a table showing measurement conditions and measurement results in Examples 7 and 8 and Comparison 2.

BEST MODE FOR CARRYING OUT THE INVENTION

An embodiment of the present invention will be described below with reference to the attached drawings.

Figure 1:
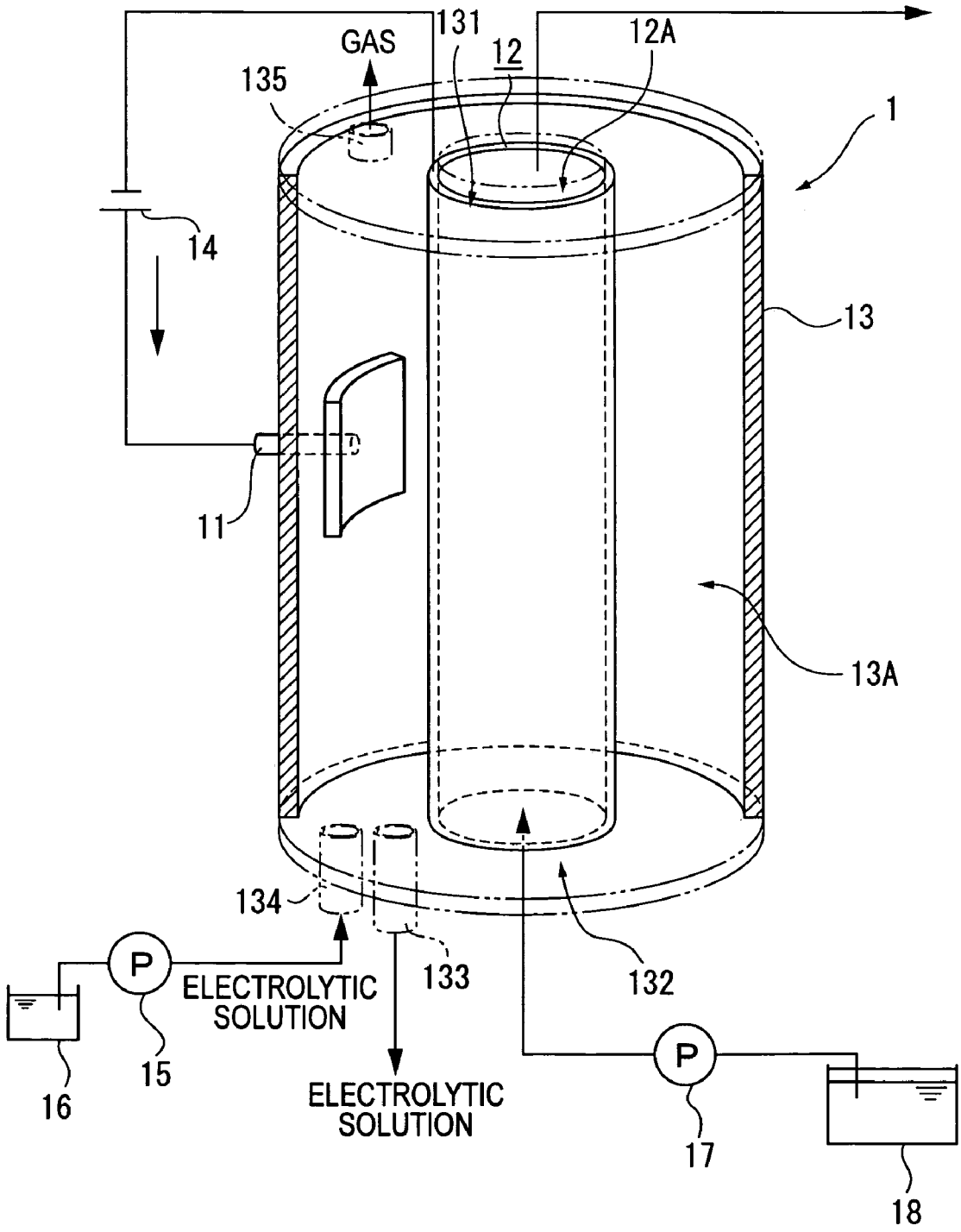
FIG. 1 is a schematic view showing a hydrogenation apparatus according to an embodiment of the present invention.

FIG. 1 shows a hydrogenation apparatus 1 of an organic compound according to the embodiment of the present invention.

The hydrogenation apparatus 1 is a hydrogenation apparatus for hydrogenating an organic compound, which includes a cylindrical reaction cell 13 having therein an anode 11 and a cathode 12 made of a material including a hydrogen storage material, a power source 14 for applying voltage to the anode 11 and cathode 12, an electrolytic solution pump 15 for supplying an electrolytic solution into the reaction cell 13, an electrolytic solution reservoir 16, an organic compound pump 17, and an organic compound reservoir 18.

Examples of the organic compound as an object to be treated include liquid aliphatic or aromatic unsaturated hydrocarbons having a double bond or a triple bond such as ethylene, propylene, 1-octene and 2-octene, acetylene, styrene, quinones, paraffins, benzaldehyde and nitrobenzene.

Also, halogenated aromatic compounds such as 2-chlorophenol, 4-chlorotoluene and dioxins may be used as the organic compound as the object to be treated, the halogenated aromatic compounds being subjected to dehalogenation reaction.

The cathode 12 is formed by a tubular member made of palladium, which divides the inside of the reaction cell 13 into an electrolytic chamber 13A and a hydrogenation chamber 12A (each described later) and penetrates the cylindrical reaction cell 13 along a central axis thereof and the organic compound as the object to be treated circulates inside the tubular member. An internal space of the tubular member is defined as the hydrogenation chamber 12A.

Palladium black is formed on an inner surface of tubular member of the cathode 12 by electrolysis reduction treatment of palladium chloride.

Further, surface roughening treatment is provided to the inner surface of tubular member of the cathode 12. Blast treatment, etching treatment and the like can be exemplified as the surface roughening treatment.

The reaction cell 13 is a cylindrical member with upper and lower sides thereof being closed with platy members, to which the electrolytic solution is supplied. A space excluding the cathode 12 in the reaction cell 13 defines the electrolytic chamber 13A. A discharge port 131 and a supply port 132 each corresponding to the inner diameter of the cathode 12 are formed at the centers of the platy members on the upper and lower sides of the reaction cell 13 for discharging and supplying the organic compound.

A discharge port 133 and a supply port 134 for discharging and supplying an electrolytic solution are provided at a radially-outer part from the center of the platy member on the lower side of the reaction cell 13.

A gas exhaust port 135 for exhausting gas generated from the electrolytic solution in the reaction cell 13 upon electrolysis is provided at a radially-outer part from the center of the platy member on the upper side of the reaction cell 13.

Although not shown, these discharge port 131, supply port 132, discharge port 133, supply port 134 and gas exhaust port 135 can be arbitrarily opened and closed by valves or the like.

The reaction cell 13 is filled with the electrolytic solution. The electrolytic solution is aqueous sulfuric acid solution of 0.01 to 10 N (normal).

When the concentration of the aqueous sulfuric acid solution is less than 0.01 N, sometimes an efficiency of electrolysis is low and thus the amount of the generated hydrogen becomes small, which is insufficient for continuously hydrogenating organic compounds.

On the other hand, when the concentration of an aqueous sulfuric acid solution exceeds 10 N, sometimes material cost increases, because sulfuric acid that produces hydrogen of more than a limit amount required for the hydrogenation is consumed.

The power source 14 is a voltage variable power source. A positive electrode of the power source 14 is connected to the anode 11, while a negative electrode of the power source 14 is connected to the cathode 12.

The electrolytic solution pump 15 supplies the electrolytic solution stored in the electrolytic solution reservoir 16 into the reaction cell 13 via the supply port 134. Although not shown, a valve or the like may be provided between the electrolytic solution pump 15 and the supply port 134.

The organic compound pump 17 supplies the organic compound stored in the organic compound reservoir 18 into the cathode 12 via the supply port 132. Although not shown, a valve or the like may be provided between the organic compound pump 17 and the supply port 132 to control feed rate of the organic compound.

A method for hydrogenating the organic compound using the hydrogenation apparatus 1 will be described below.

First, by actuating the electrolytic solution pump 15, the electrolytic solution stored in the electrolytic solution reservoir 16 is supplied into the electrolytic chamber 13A of the reaction cell 13 via the supply port 134. After checking that the electrolytic chamber 13A is filled with the electrolytic solution, the power source 14 is actuated to apply voltage between the anode 11 and cathode 12.

At this time, the voltage applied between the anode 11 and cathode 12 is not particularly limited but, from the point of the apparatus, 0.1 to 100 V is preferable.

In the electrolytic solution, electrolysis starts, and since the electrolytic solution is aqueous sulfuric acid solution which is acidic, reactions described below occur on contact surfaces of the anode 11 and cathode 12 contacting with the electrolytic solution. A reaction represented by Formula (IV) below occurs on the anode 11.

$$2H_2O \rightarrow O_2 + 4H^+ + 4e^- \quad \text{(IV)}$$

A reaction represented by Formula (V) below occurs on the cathode 12.

$$H^+ + e^- \rightarrow Had \quad \text{(V)}$$

In Formula (V), Had is adsorbed hydrogen. The Had in Formula (V) is held on the outer surface of cathode 12 in an adsorbed state. The adsorbed hydrogen is converted into an absorbed state on a tube wall of cathode 12 as represented by Formula (VI) below.

$$Had \rightarrow Hab \quad \text{(VI)}$$

In Formula (VI), Hab is absorbed hydrogen.

After power distribution from the power source 14 starts and electrolysis starts in the electrolytic solution, by actuating the organic compound pump 17, the organic compound stored in the organic compound reservoir 18 is circulated inside the tube portion of cathode 12, that is, the hydrogenation chamber 12A via the supply port 132.

At this time, feed rate of the organic compound can be controlled by adjusting the organic compound pump 17.

Hydrogen absorbed in the cathode 12 (Hab in Formula (VI)) reaches the hydrogenation chamber 12A of the cathode 12, which reacts with the organic compound supplied to the hydrogenation chamber 12A to reduce the organic compound.

Incidentally, during conducting the electrolysis, $O_2$ and $H_2$ gas are generated in the reaction cell 13, as shown in above Formulae (IV) and (V). Therefore, the gas exhaust port 135 is appropriately opened and closed to exhaust gasses of $O_2$ and excess $H_2$ gas that has not been absorbed.

As for a more specific method for hydrogenating unsaturated organic compounds using the hydrogenation apparatus 1, for example, a following method can be employed.

1 mmol of reaction substrate is dissolved in an organic solvent (such as methanol or ethyl acetate) to prepare 10 ml of a 0.1 M solution. Pre-electrolysis is previously conducted (around 100 to 500 mA, 500 C) up to a state in which palladium black on the inner surface of the palladium tube of the cathode 12 absorbs hydrogen sufficiently. Subsequently, electrolysis is conducted while circulating the prepared solution inside the tube at various flow rates. Electrolysis current value is suitably set while considering both of time period for reaction and current efficiency. When the reaction time is intended to be set as short as possible, electrolysis is preferably conducted with a large current value. However, in this case, current efficiency is lowered. On the other hand, when it is intended to conduct the reaction with an enhanced current efficiency, a small current value is selected. However, in this case, the reaction time increases.

Relation between the electrolysis current value and the cell voltage is as shown in FIG. 2 when, for instance, surface area of an electrolysis cell is 8 $cm^2$ and the electrolytic solution is a 0.3 M aqueous sulfuric acid solution.

According to the embodiment described above, following advantages can be obtained.

(1) Since the cathode 12 is made of a material including a hydrogen storage material, and is arranged as a tubular member so that the organic compound as the object to be treated circulates inside, when electrolysis is conducted in the reaction cell 13 filled with the electrolytic solution, hydrogen is generated on the outer surface of cathode 12, and the generated hydrogen is absorbed in the tube wall of cathode 12. Then, since the organic compound circulating inside the tube is in a state surrounded by the tube wall of the cathode, it can easily contact with the tube wall in which hydrogen is absorbed, and a contact area effective for hydrogenating the organic compound becomes larger as compared to that of a conventional cathode having a division plate-like shape or the like. Thus, the efficiency of hydrogenation of the organic compound can be enhanced.

(2) Since palladium has very high hydrogen permeability, and a catalytic activity for hydrogenation, it is suitable as the hydrogen storage material for the cathode 12.

(3) Palladium black is formed on the inner surface of the tubular member of the cathode 12 by electrolysis reduction treatment of palladium chloride, and since palladium black acts as a catalyst upon hydrogenation reaction, reaction rate can be enhanced.

(4) Since surface-roughening treatment is provided on the inner surface of the tubular member of the cathode 12, substantial surface area, thereby enhancing reactivity of hydrogenation reaction of the organic compound.

Incidentally, the present invention is not limited to the aforementioned embodiment, and any variations and improvements are included in the present invention so far as the object of the present invention can be achieved.

Although platinum is used as the anode 11 in the aforementioned embodiment, carbon, nickel, stainless-steel or the like may also be used.

Although the tubular member having the circular cross section is used as the cathode 12 in the aforementioned embodiment, the cathode 12 may have a polygonal cross section such as triangle, quadrangle and pentagon, or may have elliptic cross section.

Although the cathode 12 is made of palladium in the aforementioned embodiment, the cathode 12 may be made of palladium alloy such as palladium-silver alloy, rare-earth metal alloy such as lanthanum-nickel alloy, misch metanickel alloy, a titanium alloy or a zirconium alloy.

Further, the cathode 12 may be filled with hydrogen storage material inside the tubular member.

Here, as for the form of the hydrogen storage material, in addition to hydrogen storage material having a shape of powder, fiber or the like, a form in which the hydrogen storage material is supported or coated on various carriers having the above-described shape can be used.

With the arrangement, the aforementioned hydrogen storage material has a large surface area, which increases area where the organic compound and hydrogen contact effectively, thereby further enhancing reaction rate.

As for the carrier, those used for usual catalysts can be exemplified, including silica, alumina, silica-alumina, activated carbon, carbon fiber and the like.

Although the organic compound to be treated is in liquid form in the aforementioned embodiment, the organic compound may be in gaseous or solid form. In the case of gaseous form, gas is passed through the cathode 12 as pressurized gas as it stands or after being pressurized. In order to allow the reaction to proceed better, gas may be blown into the cathode 12. In the case of solid, it may be suspended in a solvent and brought into contact with the cathode, or may be made into powder and blown as it stands into the cathode.

Specific configurations and profiles when implementing the present invention may be other configurations or the like as long as the object of the present invention can be attained The present invention will be described more specifically referring to Examples and Comparisons. However, the present invention is not limited to the content of the Examples and the like.

EXAMPLES 1 TO 5

Hydrogenation reaction of an organic compound was conducted by using the hydrogenation apparatus 1 of the aforementioned embodiment.

(1) Modification of Inner Surface of Palladium Tube of Cathode 12 with Palladium Black:

Prior to hydrogenation reaction of the organic compound, palladium black was formed on an inner surface of a tubular member as the cathode 12 by electrolysis reduction treatment of palladium chloride according to the following procedure.

Around 100 to 300 mg of $PdCl_2$ was added to a 1 M aqueous hydrochloric acid (HCl) solution and stirred to dissolve to a maximum extent. The prepared solution was circulated inside a palladium tube at a flow rate of 2.5 $cm^3$/min using a pressure feed pump or a pump for liquid chromatography.

Electrolytic reduction was conducted using the palladium tube (inner diameter 2.5 mm, length 8 cm) as a cathode at a constant current (80 mA/$cm^{-2}$ to 500 mA/$cm^{-2}$) (Translator's comment: correctly, 80 mA/$cm^2$ to 500 mA/$cm^2$) to modify the inside of the palladium tube with palladium black. At this time, hydrogenation reaction can be conducted more effectively by performing modification after filling the tube with carbon fiber and the like.

(2) Hydrogenation Reaction of Organic Compound:

Each 1 mmol of unsaturated organic compounds shown in Entry of FIG. 2 (Translator's comment: correctly, FIG. 3) was dissolved in ethyl acetate to prepare 10 ml of a 0.1 M solution. The hydrogenation apparatus 1 of the present invention was applied to the respective unsaturated organic compounds shown in FIG. 2 (Translator's comment: correctly, FIG. 3) starting from the top column downward, which defines Examples 1 to 5 in this order.

Using the hydrogenation apparatus 1, which is provided with a platinum wire as the anode 11 and a palladium tube having been modified according to method (1) as the cathode 12 in a 0.3 M aqueous sulfuric acid solution, constant-current electrolysis (electrical flow 2 F/mol) was conducted at 260 mA while flowing each of the prepared solutions of Examples 1 to 5 into the palladium tube at a flow rate of 0.8 $cm^3$/min by a pressure feed pump, and hydrogenation of the unsaturated organic compound was conducted. A cell voltage at this time was about 2.9 V.

After the reaction ends, the solution was collected and concentrated and, finally, analyzed qualitatively/quantitatively with NMR, GC and GC-MS to obtain yield and current efficiency. The results are shown in FIG. 3.

EXAMPLE 6

Ethyl cinnamate was used as an unsaturated organic compound and hydrogenation was conducted under the same measurement conditions as those in Examples 1 to 5. Then, yield and current efficiency were obtained in the same way as described above. Measurement conditions and measurement results are shown in FIG. 4.

[Comparison 1]

Using a cell represented in the aforementioned patent document 1 (Translator's comment: correctly, Japanese Patent Laid-open Application No. 9-184086), in which an electrolytic chamber and a hydrogenation chamber is divided by a palladium plate, hydrogenation reaction of organic substance was conducted under the following conditions.

(1) Modification of Palladium Plate with Black Palladium:

A diaphragm type electrolysis cell was assembled using a palladium plate (effective surface area of about 2.2 $cm^2$) having a thickness of 50 μm, which served both as a diaphragm and a cathode. The electrolytic chamber side was filled with a 0.3 M aqueous sulfuric acid solution, while the reaction chamber side was filled with 15 ml of a 28 mM $PdCl_2$ solution prepared by dissolving 74 mg of $PdCl_2$ in a 1 M aqueous HCl solution.

Using a 2 cm×2 cm platinum plate as an anode, and a palladium plate of the aforementioned specification as a cathode, a constant-current electrolysis at 50 mA/$cm^2$ was conducted for 1 hour to deposit palladium black on the palladium plate surface of the reaction chamber side.

(2) Hydrogenation Reaction of Organic Compound:

Using the electrolysis cell having a specification similar to that described in the aforementioned patent document 1 (Translator's comment: correctly, Japanese Patent Laid-open Application No. 9-184086), to which the above-described treatment (1) had been provided, hydrogenation reaction of ethyl cinnamate was conducted according to the following procedure.

In the reaction chamber side, 10 ml of a 0.1 M solution was prepared by dissolving 1 mmol of ethyl cinnamate in ethyl acetate. A constant-current electrolysis was conducted at a current value of 260 mA and an electrical flow of 2 F/mol to hydrogenate ethyl cinnamate. A cell voltage at this time was 2.4 V.

After the reaction ends, the solution was collected and concentrated and, finally, analyzed qualitatively/quantitatively with NMR, GC and GC-MS to obtain yield and current efficiency. Conditions and results at that time are shown in FIG. 5.

[Evaluation Results]

As shown in FIG. 3, it was confirmed that the hydrogenation apparatus 1 was able to hydrogenate various unsaturated organic compounds, and had very high yield and current efficiency, which was excellent.

Further, as shown in FIG. 4, it was confirmed that the hydrogenation apparatus 1 according to the present invention had very high yield and current efficiency as compared to the conventional hydrogenation apparatus provided with the palladium plate even under the same reaction conditions, and that the hydrogenation apparatus was highly-effective as compared to the conventional one.

Furthermore, an inner surface area of the palladium tube in Example 6 was 7 $cm^2$ and the surface area of the palladium plate in Comparison was 2.2 $cm^2$. Calculation of current efficiency per unit area based on these surface areas gave 13%/$cm^2$ for Example 6 and, on the other hand, 4.5%/$cm^2$ for Comparison. From the result, it was confirmed that the hydrogenation apparatus 1 in Example 6 has a higher current efficiency per unit area.

EXAMPLES 7, 8 AND COMPARISON 2

As one embodiment of hydrogenation reaction of chlorinated aromatic compounds, 2-chlorophenol was dechlorinated and, at the same time, yield, current efficiency and current efficiency per unit area were compared between conditions where a palladium tube electrode was used and a palladium plate electrode was used.

(1-a) Modification of Inner Surface of Palladium Tube of Cathode 12 with Palladium Black:

For the palladium tube electrode used for the hydrogenation apparatus 1 in Example 7, prior to dechlorination reaction of a chlorinated aromatic compound, palladium black was formed on the inner surface of tubular member of the cathode 12 by electrolytic reduction treatment of palladium chloride according to the following procedure as was the case with Example 1.

That is, around 100 to 300 mg of $PdCl_2$ was added to a 1 M aqueous hydrochloric acid (HCl) solution and stirred to dissolve to a maximum extent. The prepared solution was circulated inside the tube at a flow rate of 2.5 $cm^3$/min using a pressure feed pump or a pump for liquid chromatography.

By conducting electrolytic reduction while using the palladium tube (inner diameter 2.5 mm, length 8 cm) as a cathode at a constant current (80 mA/$cm^2$ to 500 mA/$cm^2$) to modify the inside of the palladium tube with palladium black.

(1-b) Modification of Inner Surface of Palladium Tube and Carbon Fiber Filled in Palladium Tube with Palladium Black:

As for the palladium tube electrode used for the hydrogenation apparatus 1 in Example 8, the tubular member of the cathode 12 was filled with carbon fiber having a diameter of about 0.2 to 0.4 mm and a length of about 10 cm, then by using a method similar to (1-a), the palladium tube electrode in which the inner surface of the palladium tube and the carbon fiber filled in the palladium tube were modified with palladium black was obtained.

(1-c) Modification of Palladium Plate with Black Palladium:

In order to prepare a palladium platy electrode used for a hydrogenation apparatus in Comparison 2, first, a diaphragm type electrolysis cell was assembled using a palladium plate having a thickness of 50 μm, which served both as a diaphragm and a cathode (surface area of palladium plate: about 2.2 $cm^2$). The electrolytic chamber side was filled with 15 ml of a 0.3 M aqueous sulfuric acid solution, while the reaction chamber side was filled with 15 ml of a 28 mM $PdCl_2$ solution for modification prepared by dissolving 74 mg of $PdCl_2$ in a 1 M aqueous hydrochloric acid solution, respectively.

Then, using a platinum plate (size: 2 cm×2 cm) as an anode and the palladium plate to be modified as a cathode, constant-current electrolysis was conducted at 50 $mA/cm^2$ for 1 hour to deposit palladium black to the palladium plate surface of the reaction chamber side.

(2) Dechlorination Treatment of Chlorinated Aromatic Compound:

The reaction chamber side of the hydrogenation apparatus 1 was filled with 10 ml of a 0.1 M aqueous 2-chlorophenol solution prepared by dissolving weighed 1 mmol of 2-chlorophenol in distilled water. The electrolytic chamber side was filled with 15 ml of a 0.3 M aqueous sulfuric acid solution.

Then, using the palladium tube electrodes obtained in the aforementioned (1-a), (1-b) and the palladium plate electrode obtained in (1-c), constant-current electrolysis were conducted under the same conditions, that is, an electrolysis current value of 260 mA and an electrical flow of 2 F/mol, to dechlorinate 2-chlorophenol. After the reaction ends, respective solutions were collected and analyzed qualitatively/quantitatively with NMR, GC and GC-MS to check a generated amount of corresponding phenol and, at the same time, to compare and evaluate yields and current efficiencies. The results are shown in FIG. 5.

As shown in FIG. 5, it was confirmed that the hydrogenation apparatus 1 in which the palladium tube electrode obtained in (1-a) was used (Example 7) and the hydrogenation apparatus 1 in which the palladium tube electrode obtained in (1-b) was used (Example 8) had very high yield of phenol as a generated product and current efficiency as compared to the hydrogenation apparatus in which the palladium platy electrode obtained in (1-c) was used (Comparison 2).

Accordingly, it was confirmed that the hydrogenation apparatus 1 of the present invention using the palladium tube electrode was an effective hydrogenation apparatus as compared to the conventional one.

Further, the inner surface area of the palladium tube electrodes obtained in (1-a) and (1-b) were 7 $cm^2$, and surface area of the palladium platy electrode obtained in (1-c) was 2.2 $cm^2$. Thus, calculation of current efficiency per unit area gave 10%/$cm^2$ for the palladium tubular electrode in Example 8, and 3.6%/$cm^2$ for the palladium platy electrode in Comparison 2. Accordingly, it was confirmed that the hydrogenation apparatus 1 of the present invention is superior also in the current efficiency per unit area.

TEST EXAMPLE 1

Using the hydrogenation apparatus 1 of the present invention, 4-chlorotoluene and 2-chlorophenol, which are chlorinated aromatic compounds, were dechlorinated.

(1) Preparation of Chlorinated Aromatic Compound Solution:

Two kinds, 4-chlorotoluene and 2-chlorophenol, were used as the chlorinated aromatic compound. Each was weighed by 1 mmol, which was dissolved in a solvent (methanol for 4-chlorotoluene, distilled water for 2-chlorophenol) to prepare 10 ml of a 0.1 M solution, respectively.

(2) Electrolytic Dechlorination Treatment:

An electrolytic dechlorination apparatus employing the hydrogenation apparatus 1 was used in a constant-current electrolysis at a current density of 50 $mA/cm^2$, while using a platinum wire as an anode and the palladium tube electrode having been modified with palladium black (surface area: 7 $cm^2$) obtained in the aforementioned (1-a) as a cathode in a 0.3 M aqueous sulfuric acid solution. Using the electrolytic dechlorination apparatus, dechlorination treatment was conducted, in which the solution prepared in (1) was circulated inside the palladium tubular electrode three times at a flow rate of 0.8 $cm^3$/min with a pressure feed pump.

Figure 6:
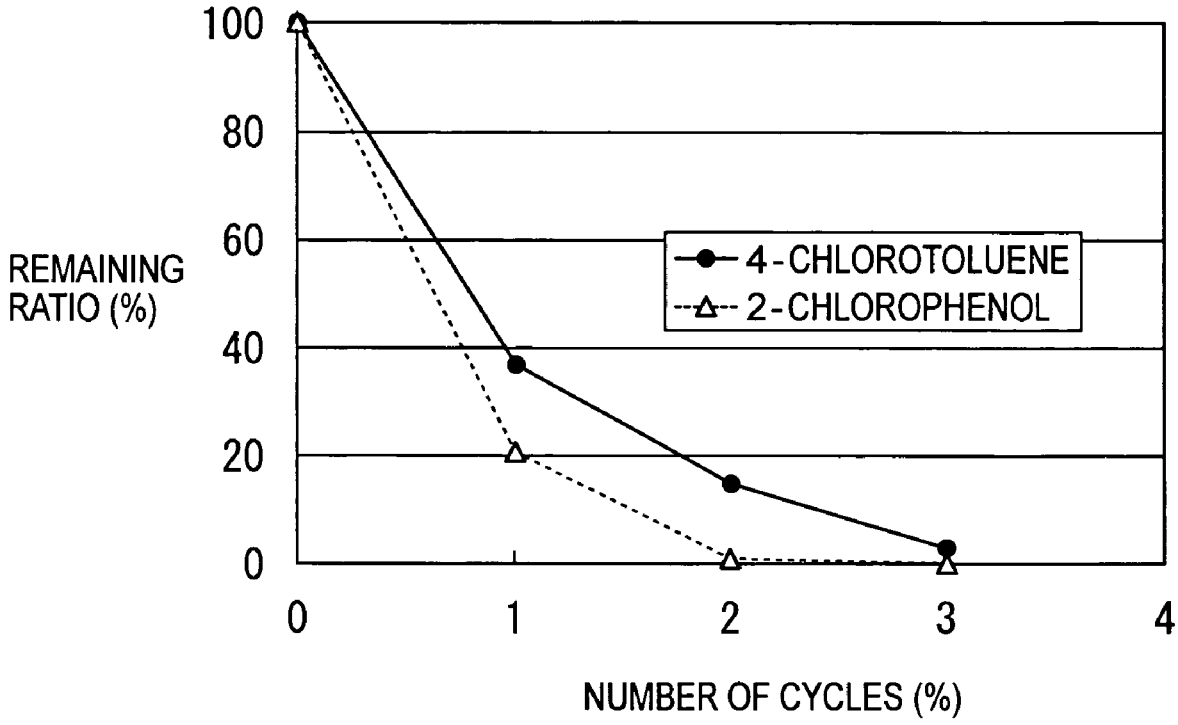
FIG. 6 is a graph showing relation of the number of cycles and remaining ratio of remaining chlorinated aromatic compound.

Then, while defining the number of times for circulating the solution in the palladium tubular electrode as number of cycles, relation between remaining ratio of the remaining chlorinated aromatic compound and the number cycles was measured and evaluated. The results are shown in FIG. 6. Qualitative/quantitative analyses were conducted with GC and GC-MS, and generation of corresponding toluene (for 4-chlorotoluene) and phenol (for 2-chlorophenol) was confirmed.

As shown in FIG. 6, in each case where a 4-chlorotoluene or 2-chlorophenol solution was used, the remaining ratio of generated toluene or phenol decreased along with proceeding of the cycle. From this result also, it was confirmed that the hydrogenation apparatus 1 of the present invention is excellent in dehalogenation treatment (hydrogenation) of halogenated aromatic compounds.

INDUSTRIAL APPLICABILITY

The present invention can be used advantageously, for example, as a hydrogenation apparatus for use in hydrogenating unsaturated hydrocarbons, halogenated compounds, long chain hydrocarbons and the like, and as a method for hydrogenating the same.

The invention claimed is:

1. An apparatus for hydrogenating an organic compound, comprising:

a reaction cell to which an electrolytic solution is supplied; and an anode and a cathode arranged in the reaction cell, wherein the cathode (i) is made of a material comprising a hydrogen storage material, and (ii) is arranged as a tubular member so that the organic compound to be treated circulates inside the cathode, and wherein the electrolytic solution provides hydrogen from the cathode at the time of the electrolysis and the hydrogen is consumed by the organic compound in the hydrogenation inside the cathode.

2. The organic compound hydrogenation apparatus according to claim 1, wherein the hydrogen storage material is palladium.

3. The organic compound hydrogenation apparatus according to claim 1, wherein the cathode is formed by treating an inner surface of the tubular member with the hydrogen storage material.

4. The organic compound hydrogenation apparatus according to claim 3, wherein the surface treatment is a formation of palladium black on the inner surface of the cathode by an electrolytic reduction treatment of palladium chloride.

5. The organic compound hydrogenation apparatus according to claim 1, wherein the cathode is formed by filling an inner part of the tubular member with the hydrogen storage material.

6. The organic compound hydrogenation apparatus according to claim 1, wherein the anode is placed within the reaction cell and outside the tubular cathode member.

7. The organic compound hydrogenation apparatus according to claim 1, wherein the electrolytic solution is selected from the group consisting of potassium hydroxide, sodium hydroxide, sulfuric acid, and hydrochloric acid.

8. A method for hydrogenating an organic compound to hydrogenate the organic compound comprising:

by using a reaction cell having an anode and a tubular cathode made of a hydrogen storage material, applying voltage between the anode and the cathode to electrolyze an electrolytic solution existing between the anode and the cathode; and circulating the organic compound as the object to be treated inside the tubular cathode to hydrogenate the organic compound.

* * * * *